United States Patent [19]

Ishikawa et al.

[11] Patent Number: 5,020,484

[45] Date of Patent: Jun. 4, 1991

[54] LUBRICATING SYSTEM FOR A TWO-CYCLE ENGINE

[75] Inventors: Hideyuki Ishikawa, Ohmiya; Mitsugi Chonan, Ibaragi; Fusao Tachibana; Shinichi Kurosu, both of Saitama, all of Japan

[73] Assignee: Fuji Jukogyo Kabushiki Kaisha, Tokyo, Japan

[21] Appl. No.: 596,789

[22] Filed: Oct. 12, 1990

[30] Foreign Application Priority Data

Nov. 6, 1989 [JP] Japan ..... 1-129951
Dec. 28, 1989 [JP] Japan ..... 1-151505

[51] Int. Cl.[5] ..... F02B 33/04

[52] U.S. Cl. ..... 123/73 AD; 123/196 R; 184/6.5

[58] Field of Search ..... 123/73 AD, 196 R, 196 CP; 184/6.5, 6.8, 6.18

[56] References Cited

U.S. PATENT DOCUMENTS 3,939,110 12/1975 Raikov et al. ..... 123/73 AD
4,632,085 12/1986 Misawa et al. ..... 123/73 AD
4,730,580 3/1988 Matsushita ..... 123/196 R
4,774,918 10/1988 Kurio et al. ..... 123/196 R
4,779,581 10/1988 Maier ..... 123/73 AD
4,829,967 5/1989 Nuti ..... 123/73 AD
4,930,462 6/1990 Kamata ..... 123/73 AD
4,932,370 6/1990 Schierling et al. ..... 123/73 AD
4,966,105 10/1990 Mori ..... 123/73 AD
4,967,700 11/1990 Torigai ..... 123/73 AD
4,970,996 11/1990 Matsuo et al. ..... 123/196 R

FOREIGN PATENT DOCUMENTS 1135240 8/1962 Fed. Rep. of Germany ..... 123/73 AD
1476133 3/1969 Fed. Rep. of Germany ..... 123/73 AD
58-169117 11/1983 Japan .
63-255543 10/1988 Japan .

*Primary Examiner*—David A. Okonsky
*Attorney, Agent, or Firm*—Martin A. Farber

[57] ABSTRACT

A two-cycle engine has an lubricating system for lubricating rubbing parts in a crankcase. A fuel injector is provided on a wall of an intake passage for injecting fuel toward an intake port of the engine. An oil injecting port is formed in the wall of the intake passage, and the fuel injector is provided for injecting fuel toward the port so as to mix with the lubricating oil.

3 Claims, 5 Drawing Sheets

LUBRICATING SYSTEM FOR A TWO-CYCLE ENGINE

BACKGROUND OF THE INVENTION

The present invention relates to a lubricating system for a two-cycle engine, and more particularly to a system for mixing lubricating oil with injected fuel.

Japanese Patent Laid-Open 63-255543 and Japanese Utility Model Laid-Open 58-169117 disclose two-cycle engines each having an independent lubricating system where the lubricating oil and fuel are separately stored in respective tanks. The lubricating oil is fed at a location adjacent an intake port of the engine. The lubricating oil and the fuel passing through the intake port are led into a crankcase, wherein the air-fuel mixture is compressed, and mixed therein. Hence, the lubricating oil is atomized and applied to necessary parts in the crankcase.

However, such a simple method does not cause the lubricating oil to sufficiently mix with the fuel. As a result, the lubricating oil is not sufficiently atomized, so that uniform lubrication can not be obtained. In addition, the spark plug of the engine may be stained by the lubricating oil, which may cause misfire and hence deterioration of emission control.

SUMMARY OF THE INVENTION

The object of the present invention is to provide an independent lubricating system for a two-cycle engine where the lubricating oil is sufficiently mixed with fuel and atomized, thereby providing uniform lubrication for the engine.

According to the present invention, there is provided a lubricating system for a two-cycle engine having an intake passage including an intake port and a fuel injector provided on a wall of the intake passage for injecting fuel toward the intake port, comprising lubricating oil supply means provided on the wall of the intake passage for supplying lubricating oil to the intake passage so as to mix with fuel injected from the fuel injector.

In an aspect of the injection, the lubricating oil supply means includes an oil injecting port formed in the wall of the intake passage, and the fuel injector is provided for injecting fuel toward the port so as to mix with the injected oil.

In another aspect of the invention, the oil injecting port is provided in the fuel injector so that the injected oil collides with fuel flowing in the injector.

The other objects and features of this invention will become understood from the following description with reference to the accompanying drawings.

DETAILED DESCRIPTION OF THE PREFERRED EMBODIMENTS

Figure 1:
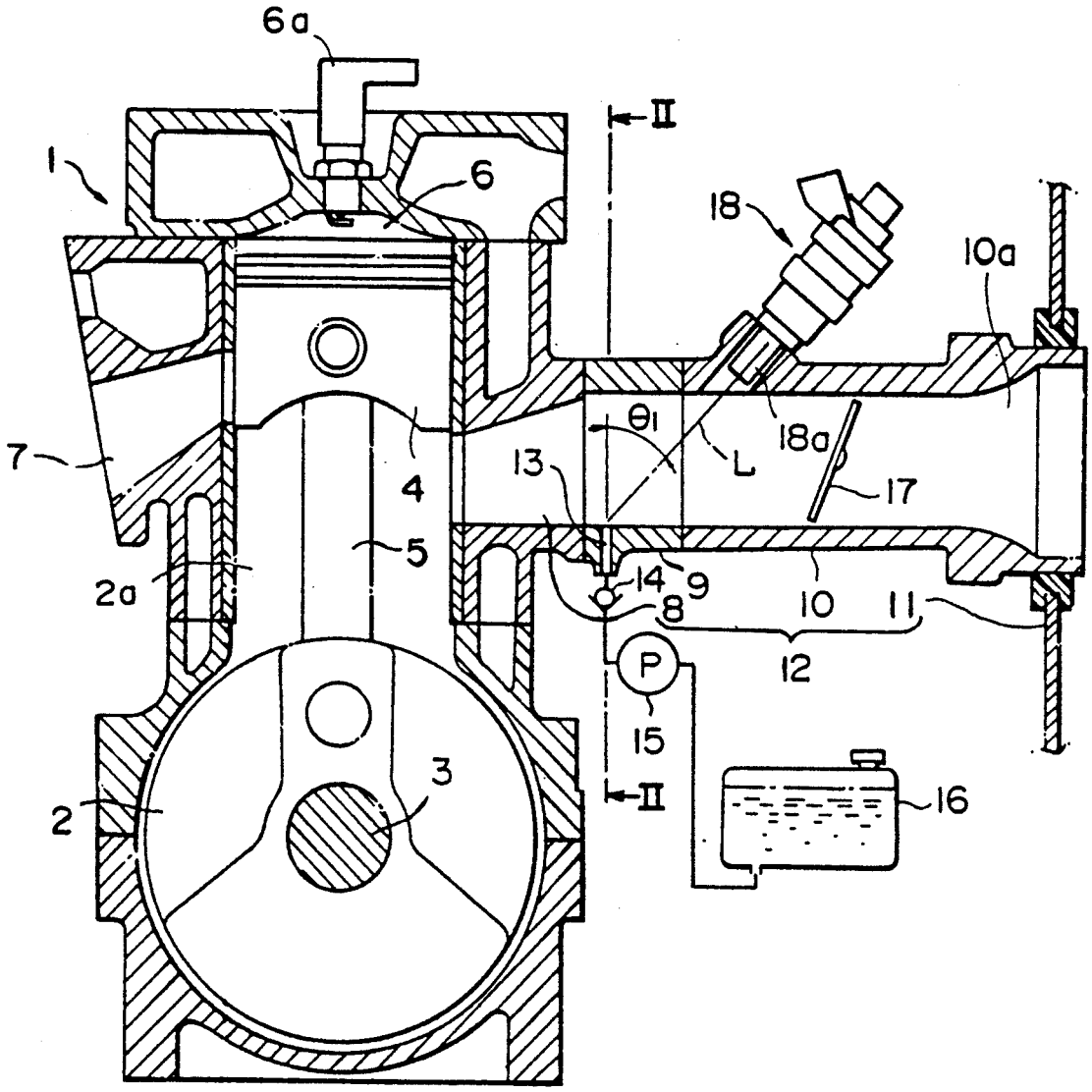
FIG. 1 is a sectional view of a two-cycle engine to which the present invention is applied.

Referring to FIG. 1, a two-cycle engine 1 for a motor vehicle such as a snowmobile comprises a cylinder 2*a*, a piston 4 provided in the cylinder 2*a* and defining a combustion chamber 6 therein, a connecting rod 5 connected with the piston 4 and a crankshaft 3 disposed in a crankcase 2. The combustion chamber 6 is communicated with the crankcase 2 through a transfer port (not shown) formed in a wall of the cylinder 2*a*. A spark plug 6*a* is provided on a top of the combustion chamber 6. In a wall of the cylinder 2*a*, an exhaust port 7 and an intake port 8 as a part of an intake passage are formed opposing one another. The exhaust port 7 and the transfer port are adapted to open at a predetermined timing with respect to the position of the piston 4. The intake port 8 has a reed valve (not shown) or a rotary valve (not shown) operatively connected to the crankshaft 3 so as to induce air to the crankcase 2 at a predetermined timing.

Air is induced in the cylinder 2*a* passing through an intake system 12. The intake system comprises an air box 11 housing an air cleaner, a throttle body 10 having a throttle valve 17 and connected to the air cleaner through an air horn 10*a*, and an adapter 9 connecting the throttle body 10 to the intake port 8. Exhaust gas of the engine 1 is discharged passing through the exhaust port 7.

Formed in the bottom of the adapter 9 is a lubricating oil injecting port 13 which is communicated with a lubricating oil tank 16 through a check valve 14 and a pump 15. The pump 15 is operatively connected to the crankshaft 3 through a power train such as a gear train (not shown).

Figure 2:
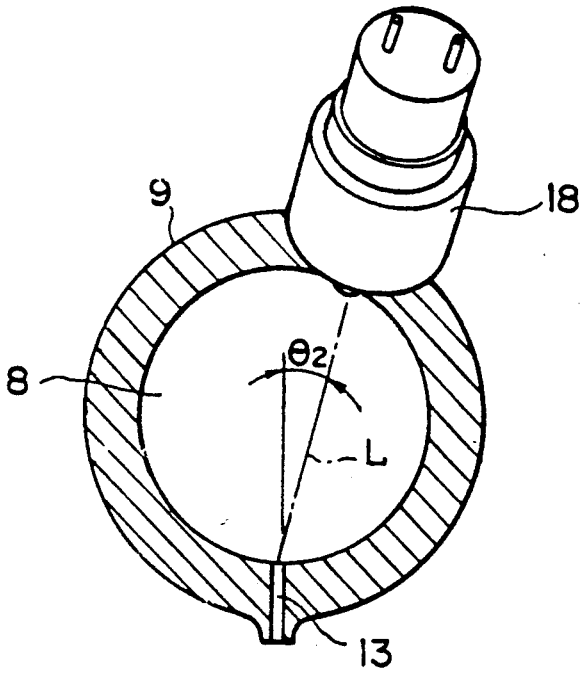
FIG. 2 is a sectional view taken on the line II—II of FIG. 1.

A fuel injector 18 having a nozzle 18*a* is provided in the throttle body 10 downstream of the throttle valve 17. The fuel injector 18 is so disposed that the extension of the axis L of the nozzle 18*a* meets the lubricating oil port 13. More particularly, as shown in FIG. 1, the axis L is inclined $\theta_1$ degrees toward the rear from the radial direction of the throttle body 10. The axis L is further deflected $\theta_2$ degrees off the center line with respect to the radial direction of the intake port 8 as shown in FIG. 2.

In operation, as the oil pump 15 is driven by the crankshaft 3 of the engine 1, the lubricating oil in the tank 16 is supplied in the adapter 9 through the check valve 14 and the lubricating oil port 13. The fuel is injected from the nozzle 18*a* of the fuel injector 18 at predetermined timing and pressure. The fuel is sprayed in a shape of a cone so that a part of the fuel collides and compulsively mixes with the lubricating oil fed from the lubricating oil port 13. Thus, the lubricating oil is atomized.

Since the fuel injector 18 is so inclined as to face the nozzle 18*a* toward the intake port 8, the oil-fuel mixture is supplied to the intake port 8 by the injecting pressure. Thus, the lubricating oil is supplied to the cylinder without causing backward flow.

As a result, parts in the crankcase 2 requiring lubrication is supplied with sufficient lubricating oil so that the smooth operation and a long life of the engine are ensured.

It is not always necessary to coincide the axis of the nozzle 18*a* with the lubricating oil port 13 as long as the fuel is directly mixed with the lubricating oil.

Figure 3:
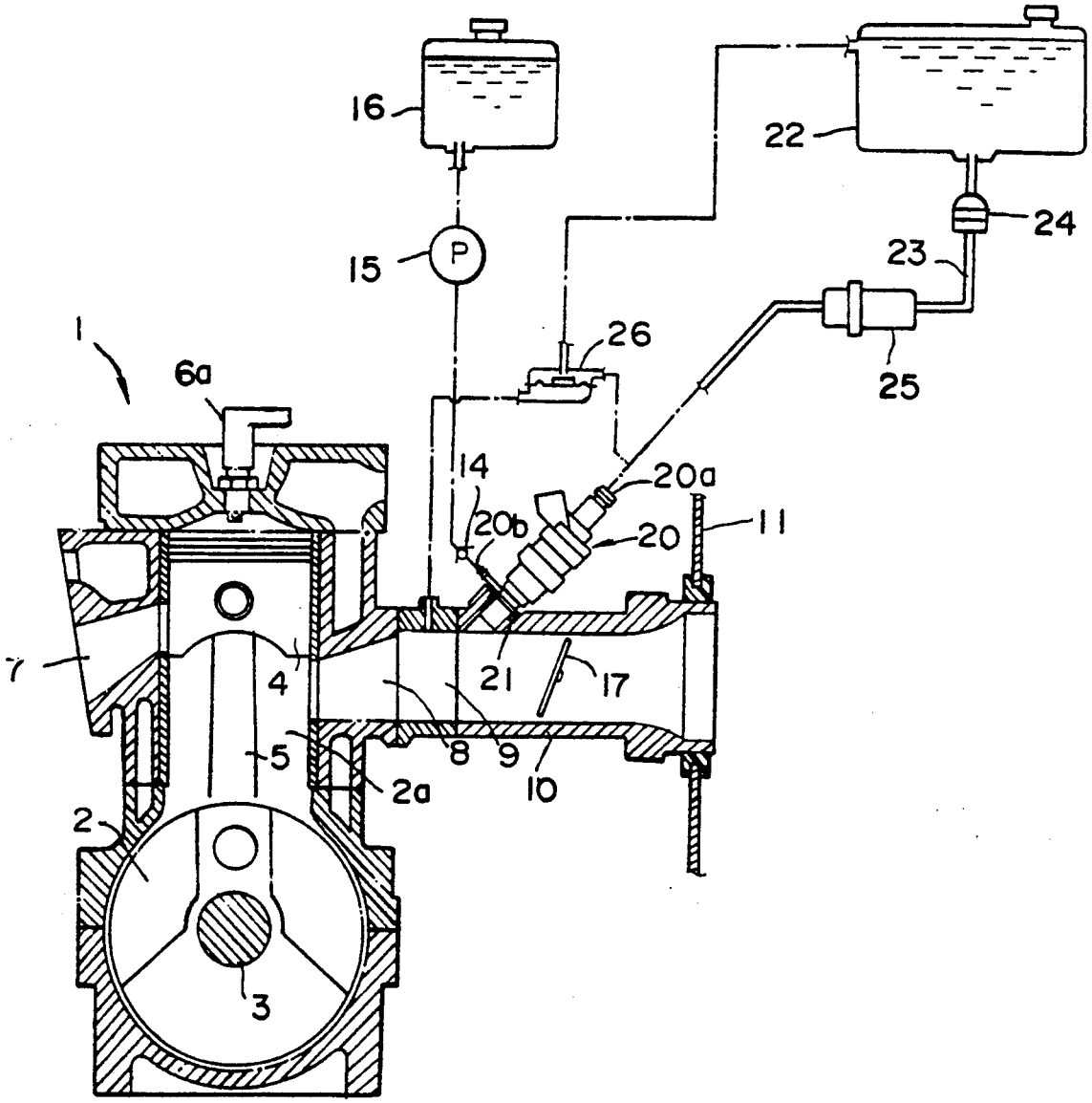
FIG. 3 is a schematic diagram showing a two-cycle engine of a second embodiment of the present invention.

FIG. 3 shows the second embodiment of the present invention where the lubricating oil can be thoroughly mixed with fuel. The same numerals as those in FIG. 1 designate the same parts in FIG. 3 as FIG. 1.

A fuel injector 20 has a fuel supply port 20*a* and a lubricating oil supply port 20*b* and is mounted in the throttle body 10 through a seal 21. The fuel in a fuel tank 22 is supplied to the fuel port 20*a* through a fuel passage 23 having a filter 24, fuel pump 25 and a pressure regulator 26 for regulating the pressure of the fuel at a predetermined value. The lubricating oil in the lubricating oil tank 16 is fed to the lubricating oil port 20*b* by the pump 15 passing through the check valve 14.

Figure 4:
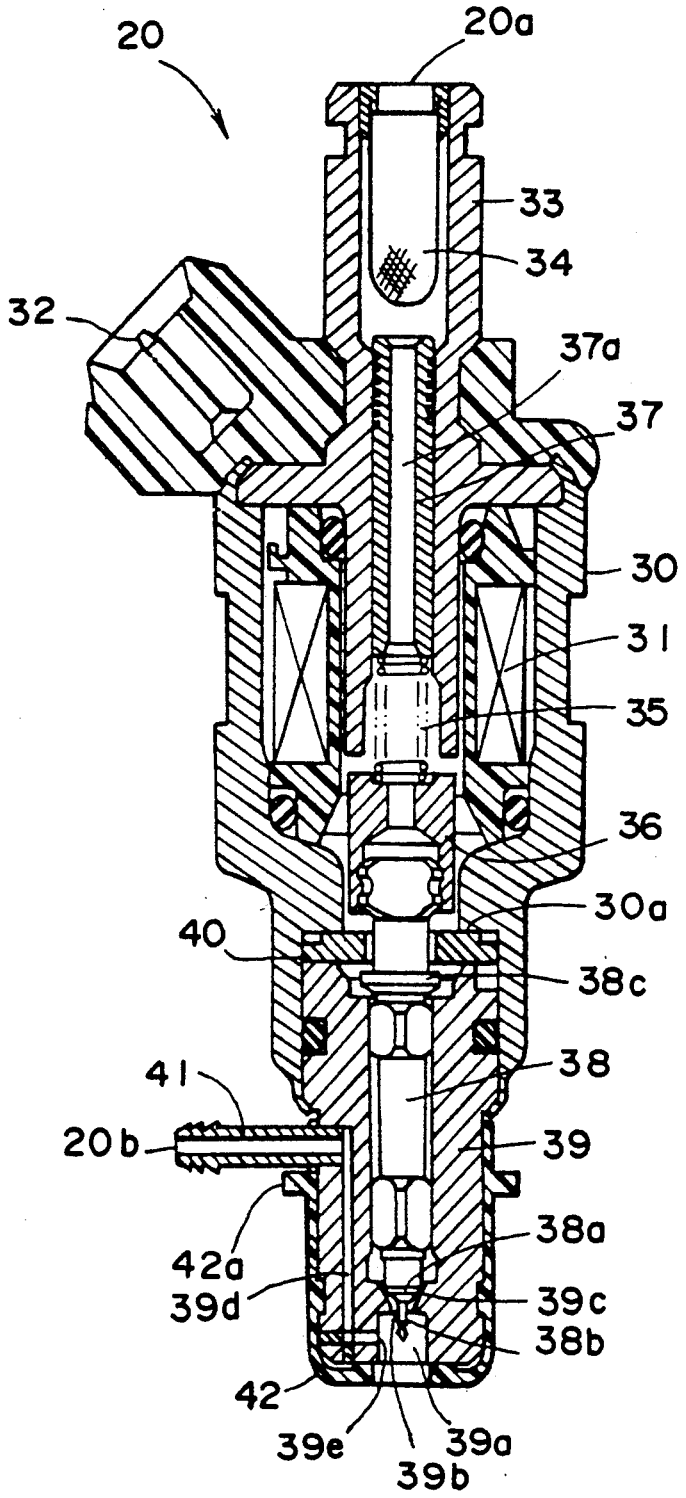
FIG. 4 is a sectional view of a fuel injector provided in the two-cycle engine shown in FIG. 3.

Referring to FIG. 4, the fuel injector 20 comprises a housing 30, a solenoid 31 disposed in the housing 30, a tubular core 33 fixed inside the housing 30, a plunger 36 slidably mounted in the housing under the core 33, a valve body 39 embedded in a recess 30*a* of the housing 30 and a needle valve 38 slidably mounted in the valve body 39 and connected to the plunger 36. An upper portion of the core 33 forms the fuel supply port 20*a* wherein a filter 34 is provided. The solenoid 31 is connected to a control circuit (not shown) through a terminal 32 so as to be energized. A tubular rod 37 is fixedly mounted in the core 33, thereby forming therein a fuel passage 37*a* communicated with the fuel supply port 20*a*. A return spring 35 is provided between the rod 37 and the plunger 36, thereby downwardly urging the plunger 36 to provide a gap between the plunger 36 and the core 33.

The needle valve 38 has a tapered valve head 38*a* which rests on a valve seat 39*c* formed on the valve body 39. A pintle 38*b* integrally formed on the valve head 38*a* passes through a fuel outlet 39*b* and protrudes into a recess 39*a* which is formed in the lower end of the valve body 39. Thus, the pintle 38*b* closes the fuel outlet 39*b*.

A stopper 38*c* is formed on an upper periphery of the needle valve 38 and a stopper plate 40 is provided in the recess 30*a* between the housing 30 and the valve body 39. When the needle valve 38 is lifted a predetermined distance, the stopper 38 abuts on the stopper plate 40, thereby preventing the valve 38 from further sliding upward. The gap between the core 33 and the plunger 36 is larger than the lifting distance of the needle valve 38, that is, of the plunger 36, so that the plunger 36 is prevented from colliding against the core 33.

On a periphery of the valve body 39, a nipple 41 is radially attached, which forms the lubricating oil supply port 20*b*. The lubricating oil supply port 20*b* is communicated with the recess 39*a* of the valve body 39 through an oil passage 39*d* formed in the valve body 39, and a lubricating oil outlet port 39*e* formed in the side wall of the recess 39 downstream of the fuel outlet 39*b*. The lubricating oil outlet port 39*e* is so positioned that the lubricating oil supplied to the recess 39*a* collides and mixes with the fuel supplied from the fuel outlet 39*b*.

A cap 42 made of a plastic material covers a bottom portion of the valve body 39. The cap 42 has a flange 42*a* for holding the seal 21 when mounting the fuel injector 20 on the throttle body 10.

The operation of the fuel injector 20 is described. The fuel pressurized by the pump 25 and kept at a predetermined pressure by the pressure regulator 26 is supplied to the fuel injector 20. When the solenoid 31 in the injector 20 is energized, the plunger 36 is attracted to the core 33 against the return spring 35. Thus, the needle valve 38 is lifted so that the valve head 38*a* disengages from the valve seat 39*c*, thereby opening the valve 38.

The pressurized fuel passes through the filter 34 in the fuel supply port 20*a*, fuel passage 37*a* and the gap between the needle valve 38 and the valve body 39 and is injected through the fuel outlet 39*b* into the recess 39*a*.

At the same time, the lubricating oil in the tank 16 is supplied to the lubricating oil supply port 20*b* passing through the check valve 14 by the pump 15. The lubricating oil passes through the oil passage 39*d* and fed to the recess 39*a* from the lubricating oil outlet 39*e*. The fuel injected from the fuel outlet 39*b* collides against the lubricating oil, thereby diffusing the oil. Thereafter, the oil-fuel mixture is led to the intake port 8.

Namely, the particles of the lubricating oil are atomized and diffused so as to be uniformly mixed with the fuel. The mixture is supplied to the engine, thereby properly lubricating the moving parts thereof. Since the lubricating oil is adequately mixed with the fuel, the spark plug 6*a* is not fouled by the lubricating oil, thereby preventing misfire. A small quantity of lubricating oil remains in the crankcase after the engine stops. Accordingly, at the restart of the engine, white smoke which is to be generated when the lubricating oil is burned is reduced.

Since the check valve 14 is provided upstream of the lubricating oil supply port 20*b*, the lubricating oil is prevented from flowing in the opposite direction and the air is prevented from entering the pump 15 at the stop of the engine. Although the pressure in the recess 39*a* reduces because of the vacuum generated in the intake port 8 lubricating oil in the oil passage 39*d* is prevented from discharging by the check valve 14.

Figure 5:
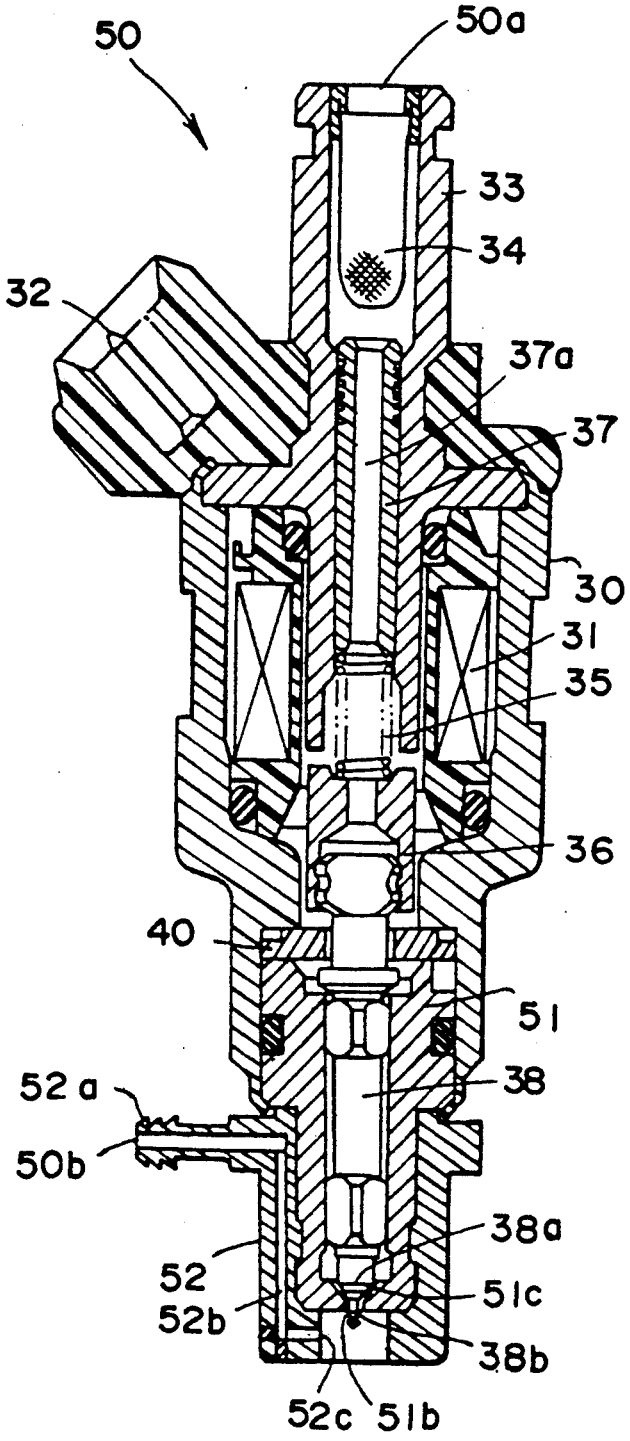
FIG. 5 is a sectional view of a modification of the fuel injector of FIG. 4.

FIG. 5 shows a fuel injector 50 having a fuel supply port 50*a* and a lubricating oil supply port 50*b* as a modification of the fuel injector 20 of the second embodiment. The same numerals as those in FIG. 4 designate the same parts in FIG. 5 as FIG. 4. In the injector 50, a valve body 51 in which the needle valve 38 is slidably mounted does not have a lubricating oil passage therein.

The valve body 51 has a valve seat 51*c* to which the tapered valve head 38*a* of the needle valve 38 is engaged by the return spring 35. Hence a fuel outlet 51*b* is closed by the pintle 38*b* when the solenoid 31 is de-energized.

An adapter 52 having an integral radial nipple 52*a* which forms the lubricating oil port 50*b* is, for example, attached to on the bottom of the valve body 51 by press fit. In the adapter 52, a lubricating oil passage 52*b* is formed so that the lubricating oil supply port 50*b* is communicated with lubricating oil outlet 52*c*. The lubricating oil outlet 52*c* is so positioned that the lubricating oil collides with the fuel injected from the fuel outlet 51*b*. Thus, the lubricating oil is diffused in and mixed with fuel in the same manner as the fuel injector 20.

The fuel injector 50 is advantageous in that parts of the injector besides the adapter 52 are common with a conventional fuel injector. Therefore, the fuel injector can be easily made from the conventional injector. The fuel injector may be further modified to employ valves other than the pintle valve.

In accordance with the present invention, there is provided a lubricating system for a two-cycle engine where the lubricating oil and the fuel are adequately mixed to enhance the atomization of the lubricating oil. The mixture including a mist of lubricating oil is effectively fed to the crankcase by the pressure of the fuel. Thus, rubbing parts in the crankcase is sufficiently lubricated thereby preventing seizure. Moreover, because the spark plug is not stained by the oil, the misfire is prevented, thereby ensuring the long service life and the reliability of the engine.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A lubricating system for a two-cycle engine having an intake passage including an intake port and a fuel injector provided on a wall of the intake passage for injecting fuel toward the intake port, comprising:

lubricating oil supply means provided on the wall of the intake passage for supplying lubricating oil to the intake passage so as to mix with fuel injected from said fuel injector.

2. The lubricating system according to claim 1, wherein said lubricating oil supply means includes an oil injecting port formed in the wall of the intake passage, and said fuel injector is provided for injecting fuel toward said port so as to mix with the injected oil.

3. The lubricating system according to claim 1, wherein said oil injecting port is provided in the fuel injector so that the injected oil collides with fuel flowing in the injector.

* * * * *